US008284228B2

(12) United States Patent
Kusunoki

(10) Patent No.: US 8,284,228 B2
(45) Date of Patent: Oct. 9, 2012

(54) IMAGE FORMING APPARATUS

(75) Inventor: Hideyuki Kusunoki, Nagoya (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 912 days.

(21) Appl. No.: 12/369,019

(22) Filed: Feb. 11, 2009

(65) Prior Publication Data

US 2009/0244567 A1 Oct. 1, 2009

(30) Foreign Application Priority Data

Mar. 27, 2008 (JP) ..... 2008-083861

(51) Int. Cl.
*B41J 2/435* (2006.01)
*B41J 2/47* (2006.01)

(52) U.S. Cl. ..... 347/237; 347/247; 347/225; 347/251

(58) Field of Classification Search ..... 347/237, 347/247, 225, 251
See application file for complete search history.

(56) References Cited

U.S. PATENT DOCUMENTS

| | | | | |
|---|---|---|---|---|
| 5,457,787 | A | 10/1995 | Asano et al. | |
| 6,038,051 | A * | 3/2000 | Suzuki et al. | 359/204.1 |
| 7,710,601 | B2 * | 5/2010 | Yaji | 358/1.9 |
| 2002/0054387 | A1 * | 5/2002 | Yokota et al. | 358/509 |
| 2006/0039040 | A1 * | 2/2006 | Asakura | 358/471 |
| 2006/0139434 | A1 * | 6/2006 | Kurose et al. | 347/183 |
| 2007/0171478 | A1 | 7/2007 | Yaji | |
| 2009/0169228 | A1 | 7/2009 | Yokoi et al. | |

FOREIGN PATENT DOCUMENTS

| | | |
|---|---|---|
| JP | 06-139176 | 5/1994 |
| JP | 09-274571 | 10/1997 |
| JP | 2004-249566 A | 9/2004 |
| JP | 2007-065125 | 3/2007 |
| JP | 2007-090571 A | 4/2007 |
| JP | 2007-118281 A | 5/2007 |
| JP | 2009-157138 A | 7/2009 |

OTHER PUBLICATIONS

JP Office Action dtd Jul. 29, 2010, JP Appn. 2008-083861, partial English translation.
JP Office Action dtd Oct. 12, 2010, JP Appln. 2008-083861, English translation.

* cited by examiner

*Primary Examiner* — Stephen Meier
*Assistant Examiner* — Sarah Al Hashimi
(74) *Attorney, Agent, or Firm* — Banner & Witcoff, Ltd.

(57) ABSTRACT

An image forming apparatus includes an exposing unit and a first processing component. The first processing component is configured to generate a first data and a second data. The first data causes the exposing unit to blink in accordance with image data. The second data sets a blink mode of the exposing unit. The image forming apparatus also includes a second processing component connected to the first processing component through a first signal line. The second processing component is configured to receive the first data and the second data from the first processing component and perform blink control of the exposing unit based on the first data and the second data. The exposing unit is connected to the second processing component through a second signal line. The image forming apparatus thus can remedy a defect in data communication to the exposing units.

8 Claims, 5 Drawing Sheets

FIG.5

TB

| PRINTING SPEED | SET VALUE (NUMBER) |
|---|---|
| FULL SPEED | 4 |
| HALF SPEED | 8 |

IMAGE FORMING APPARATUS

CROSS REFERENCE TO RELATED APPLICATION

This application claims priority from Japanese Patent Application No. 2008-083861 filed on Mar. 27, 2008. The entire content of this priority application is incorporated herein by reference.

TECHNICAL FIELD

The present invention is related to an image forming apparatus. Specifically, the present invention is related to a signal supply to an exposing unit of the image forming apparatus.

BACKGROUND

An image forming apparatus that forms an electrostatic latent image on a photosensitive drum is generally known. Such an image forming apparatus includes an upper cover, and the upper cover is provided with an LED exposing unit having a plurality of LED elements. In the image forming apparatus, a controller (a processing component) is disposed in the apparatus body so that the controller controls exposure processing of the LED exposing unit. Furthermore, a predetermined signal line connects the processing component to the LED exposing unit.

In recent years, however, as the resolution is being upgraded, the number of the LED elements in the exposing unit has increased. This causes increase in volume of image data sent to the LED exposing unit and, accordingly, increase in number of signal lines connecting the processing component to the LED exposing unit. Furthermore, in a case where a distance between the LED exposing unit and the processing component is longer, noises deriving from the signal lines tend to easily occur, which can cause problems.

Thus, there is a need in the art for an image forming apparatus that can remedy defects in data communication to an exposing unit.

SUMMARY

The image forming apparatus as an aspect of the present invention includes an exposing unit and a first processing component configured to generate a first data and a second data, the first data causing the exposing unit to blink in accordance with image data, and the second data setting a blink mode of the exposing unit. The image forming apparatus also includes a second processing component connected to the first processing component through a first signal line. The second processing component is configured to receive the first data and the second data from the first processing component, and to perform blink control of the exposing unit based on the first data and the second data. The exposing unit is connected to the second processing component through a second signal line.

With this aspect, blink control of the exposing unit is processed by the second processing component (such as a sub ASIC). This can remedy defects (such as increase in number of the signal lines) in direct data communication between the first processing component (such as a main ASIC) and the exposing unit.

Note here that the "blink" includes not only turning on and off of the exposing unit but also change in degree of lightness (luminous intensity) of the light emitted from the exposing unit, i.e. increase and decrease in brightness of the light from the exposing unit.

BRIEF DESCRIPTION OF THE DRAWINGS

FIG. 5 is a table to estimate a processing termination timing of the sub ASIC in another illustrative aspect.

DETAILED DESCRIPTION

1. General Configuration of Printer

Figure 1:
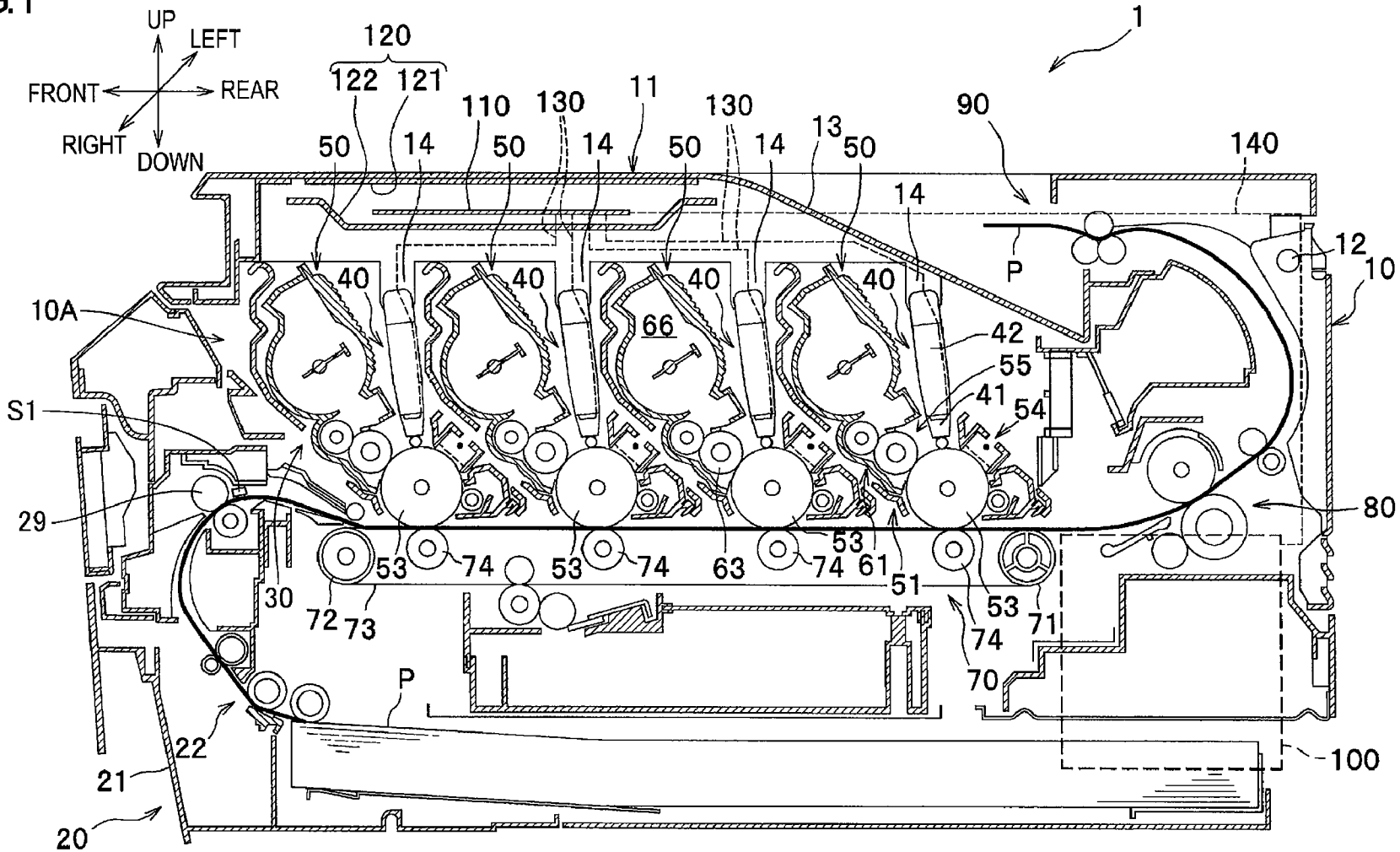
FIG. 1 is a cross-sectional view showing a general configuration of a color printer of one illustrative aspect of an image forming apparatus in accordance with the present invention.

An illustrative aspect in accordance with the present invention will now be described with reference to FIGS. 1 through 4. FIG. 1 is a cross-sectional view showing a general configuration of a color printer 1 (an illustration of an image forming apparatus). Note that the image forming apparatus is not limited to the color printer; for example, the image forming apparatus may be a so-called multi-function machine having a copy function and a facsimile function.

The left side in FIG. 1 represents the front side of the printer, and the right side represents the rear side of the printer. Likewise, the far side and the near side in the same figure are the left and the right sides of the printer, respectively. In addition, the vertical direction in the figure is the vertical direction of the printer.

As shown in FIG. 1, the color printer 1 includes a body 10, a sheet feeding unit 20, an image forming mechanism 30, a sheet discharge portion 90, and a main substrate 100. The sheet feeding unit 20, the image forming mechanism 30, the sheet discharge portion 90, and the main substrate 100 are accommodated in the body 10. The sheet feeding unit 20 supplies sheets P (an illustration of recording media; herein sheet is broadly defined as paper, plastic, and the like). The image forming mechanism 30 forms images on the fed sheets P. The sheet discharge portion 90 discharges the sheets P bearing images formed thereon. The main substrate 100 performs control of the printing mechanism when forming images.

The body 10 has an opening 10A in the top thereof and an upper cover 11 (an illustration of a cover) that opens and closes the opening 10A. A pivot axis 12 is provided in the rear side, and the upper cover 11 can upwardly and downwardly pivot about the pivot axis 12. An upper face of the upper cover 11 serves as a sheet discharge tray 13 where the sheets P discharged from the body 10 are stacked. The lower face of the upper cover 11 is provided with a plurality of holding members 14. The holding members 14 hold LED units 40 (an illustration of exposing units). Furthermore, the upper cover 11 has a shielding member 120 provided therein.

The shielding member 120 shields noises such as electromagnetic waves generated in a LED control substrate 110. The shielding member 120 is configured by, as shown in FIG. 1, an upper shielding plate 121 and a lower shielding plate 122. The upper shielding plate 121 is opposed to the upper face of the LED control substrate 110, while the lower shielding plate 122 is opposed to the lower face of the LED control substrate 110.

The sheet feeding unit 20 is provided in a lower portion of the body 10 and mainly includes a sheet feed tray 21 and a sheet feeding mechanism 22. The sheet feed tray 21 is detachably attached to the body 10. The sheet feeding mechanism 22 conveys the sheets P from the sheet feed tray 21 to the image forming mechanism 30. The sheets P in the sheet feed tray 21 are separated one by one by the sheet feeding mechanism 22 and fed upwardly. Thereafter, a registration roller 29 corrects the position of each of the sheets P. Each sheet P then passes through the registration roller 29 and is supplied to the image forming mechanism 30.

A sensor S1 is disposed downstream the registration roller 29 in the sheet conveying direction and just behind the registration roller 29. The sensor S1 (an illustration of a sensor that detects a recording medium passing) detects the sheet P passing. The sensor SI generates a detection signal Sg that changes in accordance with passage of a leading edge and passage of a trailing edge of the sheet P, and supplies the detection signal Sg to the main substrate 100. For example, upon detection of the leading edge of the sheet P, the sensor S1 generates the detection signal Sg changing from a lower level to a higher level and, upon detection of the trailing edge of the passing sheet P, the sensor S1 generates the detection signal Sg changing from the higher level to the lower level.

The image forming mechanism 30 is configured mainly by four LED units 40, four process cartridges 50, a transfer unit 70, and a fixing unit 80. The LED units 40 (an illustration of exposing units) are disposed above photosensitive drums 53. Each of the LED units 40 mainly includes a LED head 41 and a back plate 42. The LED heads 41 each are opposed to the respective photosensitive drums 53.

Each of the LED heads 41 has a plurality of LEDs (light-emitting diodes: an illustration of light-emitting elements), which are not illustrated in the figures. The LEDs are disposed in a lateral array on a LED head surface opposed to the photosensitive drum 53. Based on data of images to form, signals are inputted from the LED control substrate 110 to each of the LEDs, whereby the LEDs emit light to expose a surface of the photosensitive drum 53. The LED control substrate 110 will be described below.

The back plates 42 are members to support the LED heads 41. The back plates 42 each are swingably attached to the upper cover 11 through the respective holding members 14. Thus, upon upward pivot of the upper cover 11, each of the LED units 40 (each of the LED heads 41) is moved upwardly from an exposing position opposed to respective one of the photosensitive drums 53 to a rest position above the exposing position.

The process cartridges 50 are, as shown in FIG. 1, disposed in a space between the upper cover 11 and the sheet feeding unit 20. The process cartridges 50 are arranged in tandem in the space. Each of the process cartridges 50 includes a drum unit 51 and a developing unit 61. The developing unit 61 is detachably attached to the drum unit 51. Note that the process cartridges 50 differ from each other only in color of toner (developer) stored in toner accommodating chambers 66 of the developing units 61, while the configurations are identical.

Each of the drum units 51 mainly includes the photosensitive drum 53 and a charger 54. When the developing unit 61 is attached to respective one of the drum unit 51, an exposing aperture 55 is defined therebetween. The exposing aperture 55allows approach from the outside to the photosensitive drum 53 therethrough. The LED unit 40 (the LED head 41) is inserted in the exposing aperture 55 so as to be opposed to an upper area of the surface of the photosensitive drum 53. Each of the developing units 61 has a developing roller 63 and a toner-accommodating chamber 66.

The transfer unit 70 is provided between the sheet feeding unit 20 and each of the process cartridges 50. The transfer unit 70 mainly includes a driving roller 71, a driven roller 72, a conveying belt 73, and four transfer rollers 74.

The conveying belt 73 extends between the driving roller 71 and the driven roller 72. The transfer rollers 74 are disposed within the loop of the conveying belt 73 with being opposed to the respective photosensitive drums 53. The transfer rollers 74 each and the respective photosensitive drums 53 hold the conveying belt 73 therebetween. In addition, the fixing unit 80 is disposed behind the process cartridges 50 and the transfer unit 70.

In the image forming mechanism 30 configured as above, first, the surfaces of the photosensitive drums 53 are uniformly charged by the respective chargers 54 and, thereafter, exposed by LED light emitted from each of the LED heads 41. Thus, the electric potential in the exposed areas are reduced, and electrostatic latent images based on the image data are formed on the photosensitive drums 53 each.

Then, toner in each of the toner accommodating chambers 66 is supplied to each respective developing rollers 63. The toner carried on the developing rollers 63 is supplied to electrostatic latent images formed on the photosensitive drums 53. The toner is selectively carried on the photosensitive drums 53, whereby the electrostatic latent images are visualized to form toner images by a reverse developing method.

Then, the sheet P supplied onto the conveying belt 73 passes between the photosensitive drums 53 and the respective transfer rollers 74 disposed within the loop of the conveying belt 73, whereby the toner images each formed on the respective photosensitive drums 53 are transferred onto the sheet one by one. When the sheet P passes through the fixing unit 80, the toner images transferred onto the sheet P are fixed by heat. The sheet P bearing the heat-fixed toner images is discharged out of the body 10 and is stacked on the sheet discharge tray 13.

2. Electrical Connection for Exposing Control

Figure 2:
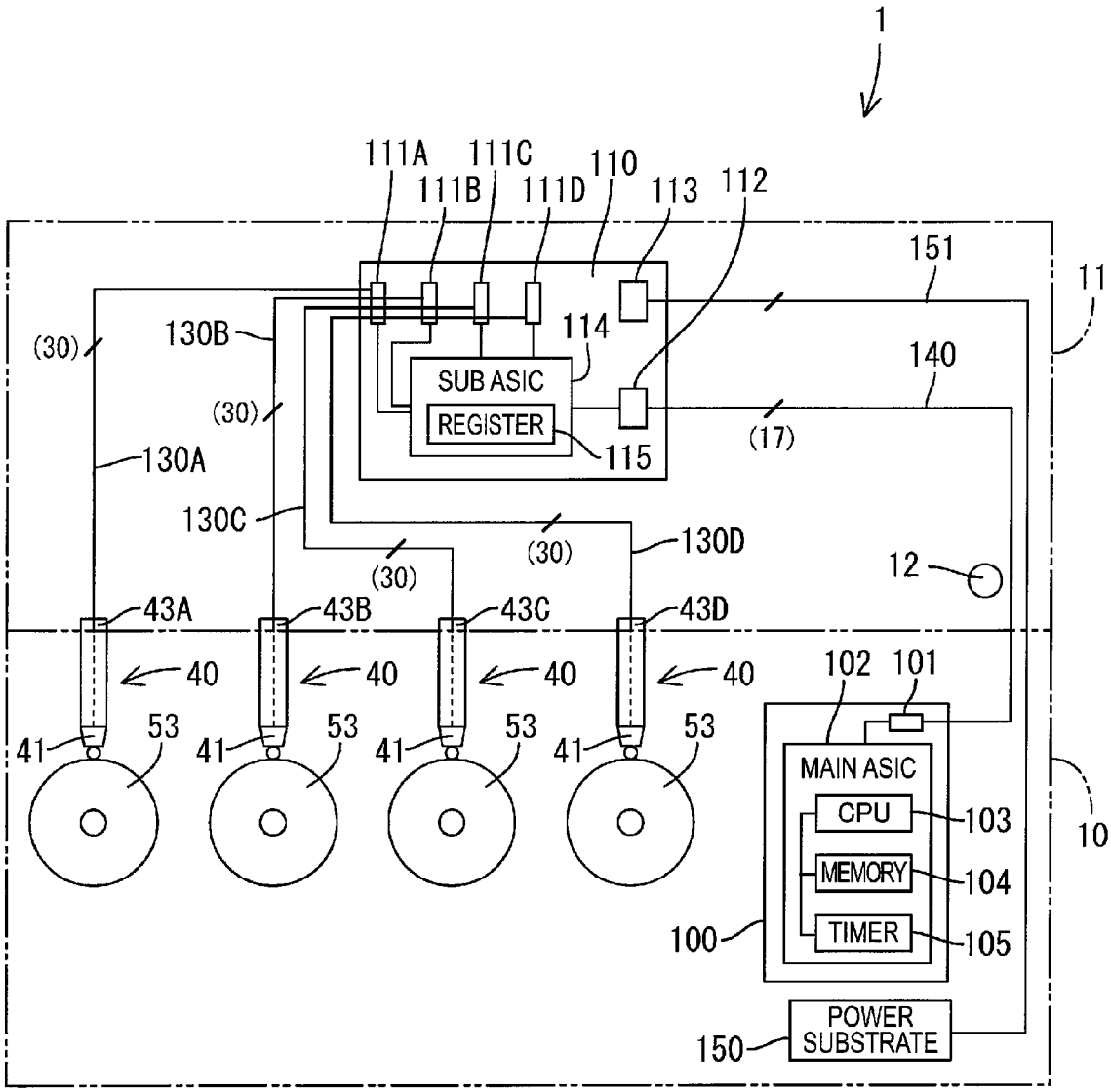
FIG. 2 is a diagram showing electrical connection of a main ASIC, a sub ASIC, and LED units.

Next, electrical connection for exposing control of this aspect will be described with reference to FIGS. 2 and 3. FIG. 2 is a schematic diagram showing electrical connection of the configuration for exposing control such as the main substrate 100, the LED control substrate 110, and each of the LED units 40.

The main substrate 100 includes a main ASIC (application specific integrated circuits) 102. The main ASIC 102 (an illustration of a "first processing component" in accordance with the present invention) has a CPU 103, a memory section 104, a timer section 105, and the like. In image forming operation, the main ASIC 102 controls each part of the printer 1. The memory section 104 has a ROM, a RAM, and a nonvolatile RAM. The timer section 105 has a plurality of timers that count predetermined processing periods of the main ASIC 102.

Specifically, the main ASIC 102 controls rotational speeds of the photosensitive drums 53 and the driving roller 71, conveying speeds of the sheets P located in the sheet feeding unit 20 and in the fixing unit 80, exposing timings, and the like directly or remotely through another control substrate (for example, the LED control substrate 110). Particularly, in the exposing control, the main ASIC 102 generates print data (print_data) (an illustration of a first data) and register setting communication data (setting_reg_data) (an illustration of a second data). The print data (print_data) is data for causing the LED units 40 to blink in accordance with the image data.

The register setting communication data (setting_reg_data) is data for setting blink modes of the LED units 40.

The LED control substrate 110 includes a sub ASIC 114 (an illustration of a "second processing component" in accordance with the present invention). The sub ASIC 114 has a register section 115 having a plurality of registers to set the blink modes of the led units 40. The sub ASIC 114 outputs the signals to each of the LEDs of each of the LED heads 41 based on the data of images to be formed, and thereby the sub ASIC 114 controls the light emission. Note that the main ASIC 102 can also read out set contents of the register section 115 of the sub ASIC 114.

Specifically, the sub ASIC 114 receives the print data (print_data) and the register setting communication data (setting_reg_data) for setting given ones of the registers of the register section 115 from the main ASIC 102 and, based on the print data and the register setting communication data, performs blink control of the LED units 40. More in details, in starting the exposure of the LED units 40, the sub ASIC 114 selects the register setting communication data (setting_reg_data) which corresponds to that print data and, thereafter, executes blink control of the LED units 40 based on the print data and in accordance with the blink modes set by the register setting communication data (setting_reg_data).

Furthermore, as shown in FIG. 2, the main ASIC 102 and the sub ASIC 114 are electrically connected by one flat cable 140 (an illustration of a first signal line). Each LED units 40 (the LED heads 41) is electrically connected to the sub ASIC 114 by respective flat cables 130 (130A-130D) (an illustration of second signal lines).

An end of each of the four flat cables 130 (130A-130D) is connected to respective ones of connectors 111A-111D. The connectors 111A-111D are provided on the LED control substrate 110. The other end of each of the flat cables 130A-130D is connected to each respective connector 43A-43D. Each of the connectors 43A-43D is provided on each respective LED unit 40. Each of the connectors 43A-43D is electrically connected to each respective LED head 41 through respective back plates 42.

Here, the number of signal lines (e.g. 17 lines) included in the flat cable 140 is much less than the number of signal lines (e.g. 120 lines) included in the four flat cables 130.

An end of the flat cable 140 is connected to a connector 112. The connector 112 is provided on the LED control substrate 110. The other end of the flat cable 140 is connected to a connector 101. The connector 101 is provided on the main substrate 100.

In addition, in this aspect, power to the LED control substrate 110 is supplied from a power substrate 150. The power substrate 150 is provided in the body 10 separately from the main substrate 100. A cable runs from the power substrate 150 and is connected to a power connector 113. The power connector 113 is provided on the LED control substrate 110. Note that the power may be supplied from the main substrate 100 to the LED control substrate 110 (the main substrate 100 may be combined with the power substrate 150).

Figure 3:
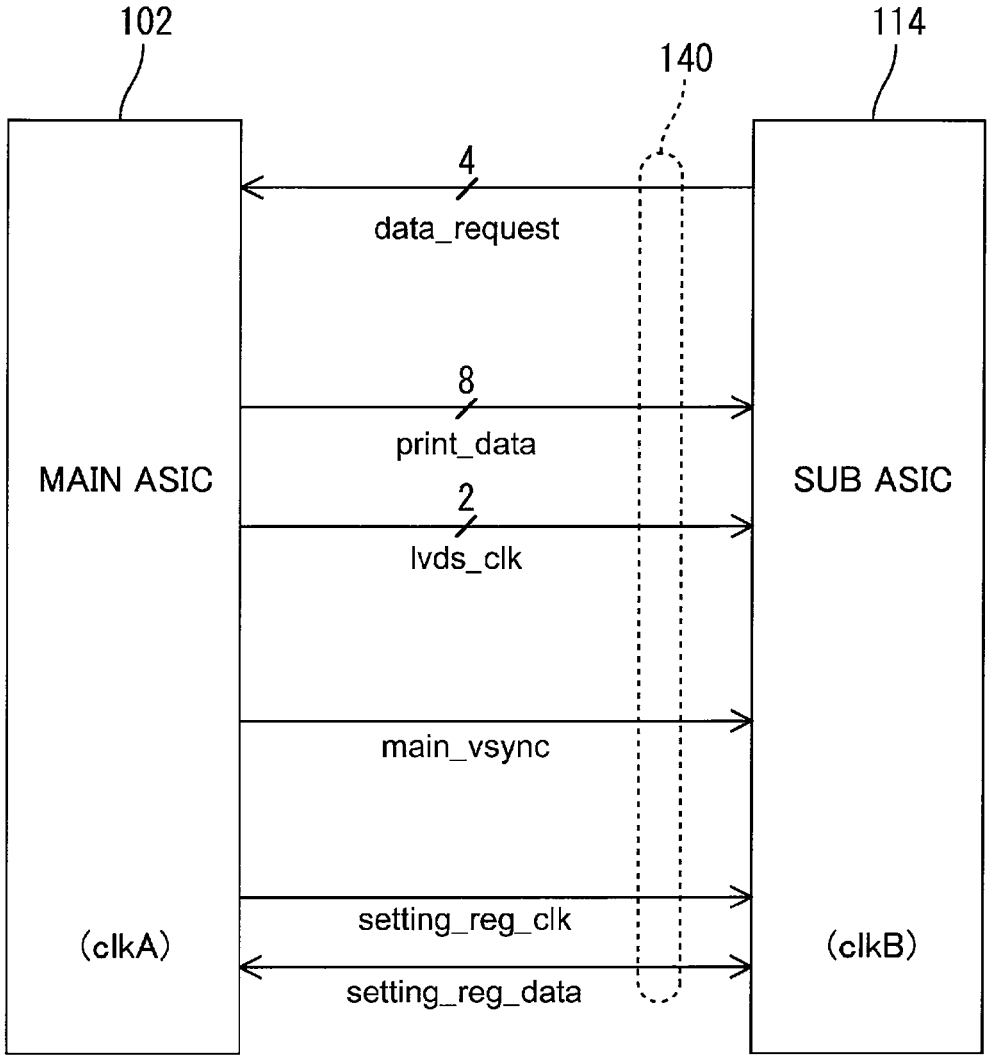
FIG. 3 is a connection diagram explaining signals between the main ASIC and the sub ASIC.

FIG. 3 is a diagram explaining signals communicated between the main ASIC 102 and the sub ASIC 114 through the flat cable 140. Note that a clock signal clkA of the main ASIC 102 and a clock signal clkB of the sub ASIC 114 are asynchronous. That is, the main ASIC 102 and the sub ASIC 114 asynchronously operate.

The flat cable 140 has, for example, 17 signal lines as described above. More in details, the flat cable 140 includes four data request lines, eight print data lines (an illustration of high-speed signal lines), two data transfer reference clock lines, one printing flag line, one register setting communication data line (an illustration of a low-speed signal line), and one register setting communication clock line.

The sub ASIC 114 sends data request signals (data_request) requesting print data (print_data) to the main ASIC 102 through the four data request lines. The main ASIC 102 transfers print data (print_data) to the sub ASIC 114 through the eight print data lines in response to the data request signals (data_request). The print data (print_data), when transferred, is synchronized with the data transfer reference clock signals (lvds_clk). The data transfer reference clock signals (lvds_clk) are sent from the main ASIC 102 to the sub ASIC 114 through the two data transfer reference clock lines.

The main ASIC 102 sends a printing flag signal (main_vsync) (an illustration of a flag signal) to the sub ASIC 114 through the one printing flag line. The printing flag signal (main_vsync) is a flag signal that indicates that the main ASIC 102 is in the course of control of printing processing.

Furthermore, the main ASIC 102 sends register setting communication data (setting_reg_data) to the sub ASIC 114 through the one register setting communication data line. The register setting communication data (setting_reg_data) is, when sent, synchronized with a register setting communication clock signal (setting_reg_clk). The register setting communication clock signal (setting_reg_clk) is sent from the main ASIC 102 to the sub ASIC 114 through the one register setting communication clock line.

Note here that the frequency of the data transfer reference clock signals (lvds_clk) is higher than the frequency of the register setting communication clock signal (setting_reg_clk). Therefore, the print data (print_data) is transferred to the sub ASIC 114 through the eight print data lines (the high-speed signal lines) and being synchronized with the high-speed data transfer reference clock signals (lvds_clk).

That is, in this aspect, the flat cable 140 is configured by the print data lines (the high-speed signal lines) and the low-speed signal lines such as the register setting communication data line, and the lower speed signal lines have lower data transfer speed than the print data lines. The high-speed signal lines are used to output at least the print data (print_data).

Here, the signal lines connecting the main ASIC 102 and the LED units 40 are separated into the flat cable 140 and the four flat cables 130. Furthermore, the LED heads 41 of the LED units 40 are configured by many LED elements. Therefore, volume of the print data (print_data) transferred through the flat cable 140 is much greater. Even with this type of configuration, in this aspect, the high-speed signal lines allows the much greater volume of print data (print_data) to be desirably transferred to the sub ASIC 114 therethrough.

As described above, in this aspect, blink control of the LED units 40 (the exposing unit) is processed by the sub ASIC 114 (the second processing component). This can remedy a defect (e.g. increase of the number of the signal lines) in direct communication of greater volume of data between the main ASIC 102 (the first processing component) and the LED units 40.

Furthermore, in the image forming apparatus such as the LED printer having the LED units 40, which is configured by many LED elements, the effects of separating the control processing for the LED units 40 into the main ASIC 102 and the sub ASIC 114, as configured in this aspect, can be desirably obtained.

3. Setting Control of Sub ASIC

Figure 4:
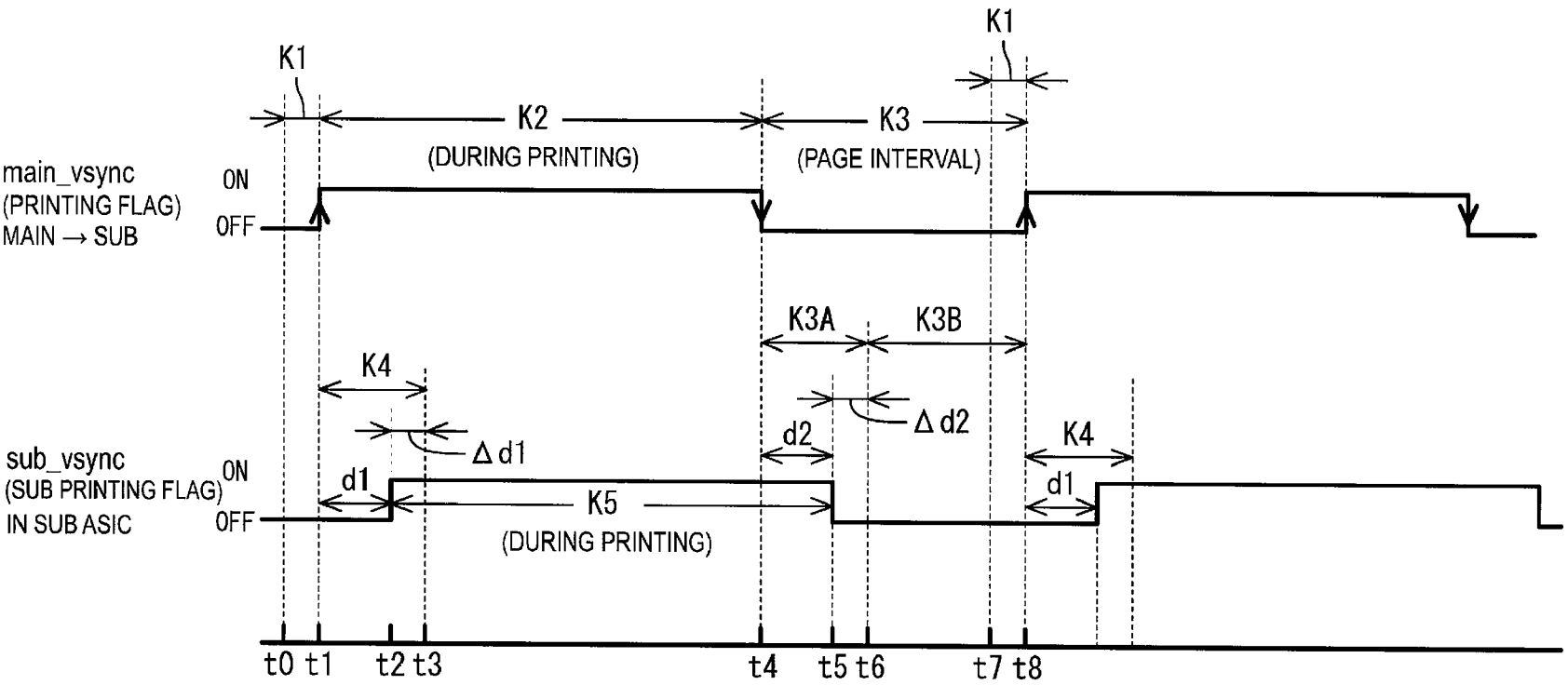
FIG. 4 is a time chart concerning setting control of the sub ASIC executed by the main ASIC.

Next, setting control of the sub ASIC 114 by the main ASIC 102 of this aspect will be described with reference to FIG. 4. FIG. 4 is a time chart concerning setting control of the sub ASIC 114 by the main ASIC 102.

Suppose that, in accordance with an instruction made by an user to print a given number of pages, the sheet P to be printed in the current printing cycle is conveyed from the sheet feed tray 21 to the image forming mechanism 30 and, at a time point (timing) t0 in FIG. 4, a leading edge of the sheet P to be printed in the current printing cycle passes the sensor S1. Then, the sensor S1 generates the detection signal Sg related to the detection of the leading edge of the sheet P, and sends the detection signal Sg to the main ASIC 102. Then, based on the detection signal Sg, at a time point t1 after a lapse of a predetermined time period K1 from the time point t0, the main ASIC 102 turns on (activates) the printing flag signal (main_vsync). The printing flag signal (main_vsync) is sent to the sub ASIC 114 through the printing flag line. At the time point t1, in addition, the main ASIC 102 issues a first interrupt to the CPU 103.

Although FIG. 4 illustratively shows the printing flag signal that becomes a high level when turned on, the signal may be a signal that becomes a low level when turned on. Furthermore, the detection signal used for activating the printing flag signal (main_vsync) is not limited to the detection signal Sg from the sensor S1 (the sensor that detects the recording medium passing). For example, a sensor (not illustrated) may be provided in front of the registration roller 29 to detect the sheet P upstream the registration roller 29 in the sheet conveying direction so that a detection signal from the sensor is used as the detection signal.

Then, at a time point t2, which is a time point after a lapse of a given delay time d1 from the time point t1, the sub ASIC 114 turns on (activates) a sub printing flag signal (sub_vsync). The sub printing flag signal (sub_vsync) is an internal control signal of the sub ASIC 114. Note that the delay time d1 includes times necessary for synchronization of the internal clocks, correction of print starting position, and the like. In addition, the delay time d1 is varied at every printed page.

The time point t2 is timing where the sub ASIC 114 starts exposure processing of the LED units 40 based on preceding print data (print data for the page of the current printing cycle) (print_data).

Here, the main ASIC 102 estimates the timing of the time point t2 using the delay time d1 from the time point t1. Therefore, the main ASIC 102 can know the time point t2 (where the sub ASIC 114 starts the exposure processing) without having any dedicated line to receive information on the exposure start time point t2 from the sub ASIC 114 therethrough.

Then, at a time point t3, after a lapse of a given time Δd1 from the time point t2 (after a lapse of a predetermined time period K4 from the time point t1), the main ASIC 102 starts outputting the partial register setting communication data (setting_reg_data) which corresponds to succeeding print data (print data for the next page) (print_data) and has no influence on the exposure processing executed by the sub ASIC 114. At the time point t3, in addition, the main ASIC 102 issues a second interrupt to the CPU 103.

That is, after the sub ASIC 114 starts the exposure processing of the LED units 40 based on the preceding print data (print_data) outputted by the main ASIC 102 to the sub ASIC 114, the main ASIC 102 starts outputting the partial register setting communication data which has no influence on the exposure processing executed by the sub ASIC 114.

Note here that the partial register setting communication data (setting_reg_data) which has no influence on the exposure processing includes, for example, a data format of the print data, timing of print start, and the like. Furthermore, the given time Δd1 is provided as a margin for variation of the delay time d1. The given time Δd1 is determined in advance by tests (and the like). Furthermore, count of the predetermined time period K4 is performed by a predetermined timer of the timer section 105 in accordance with a predetermined number of counts.

As described above, in this aspect, the main ASIC 102 outputs the partial register setting communication data of the succeeding next page to the sub ASIC 114 before the sub ASIC 114 terminates the processing based on the preceding print data. This improves the processing performance of the LED units 40 in comparison with the case where the sub ASIC 114 terminates the same processing as above and, thereafter, the main ASIC 102 outputs the succeeding print data and entire register setting communication data.

Next, at a time point t4 where a printing period K2 elapses from the time point t1, the main ASIC 102 turns off (deactivates) the printing flag signal (main_vsync). Here, for example, based on the detection signal Sg of the sensor S1 at the time when the trailing edge of the sheet P printed in the current printing cycle passes, the main ASIC 102 turns off the printing flag signal. Then, at a time point t5 after a lapse of a given delay time d2 from the time point t4, the sub ASIC 114 turns off (deactivates) the sub printing flag signal (sub_vsync). In addition, at the time point t4, the main ASIC 102 issues a third interrupt to the CPU 103.

Note that the delay time d2 includes a time necessary for synchronization of the internal clocks, a time of noise cancel, and a correction time of print timing in the secondary scanning direction. In addition, the delay time d2 is varied at every printed image.

The time point t5 is timing where the sub ASIC 114 terminates the exposure processing of the LED units 40 based on the preceding printed data (print data for the page of the current printing cycle) (print_data). Here, the main ASIC 102 estimates the timing of the time point t5 using the delay time d2 from the time point t4.

Then, at a time point t6 after a lapse of a given time Δd2 from the time point t5 (after a lapse of a predetermined time period K3A from the time point t4), the main ASIC 102 starts outputting the partial register setting communication data which corresponds to the succeeding print data (print_data) and has an influence on the exposure processing executed by the sub ASIC 114. The output of this partial register setting communication data is performed during a time period K3B from the time point t6 to a time point t8. In addition, at the time point t6, the main ASIC 102 issues a fourth interrupt to the CPU 103.

Note here that the partial register setting communication data (setting_reg_data) which has the influence on the exposure processing includes, for example, dot correction data (correction of dot (exposing) positions caused by a warp of the led heads 41 and the like), data for VSYNC (sub_vsync) generation circuit in the sub ASIC 114, and the like. Furthermore, the given time Δd2 is provided as a margin for variation of the delay time d2. The given time Δd2 is determined in advance by tests and the like. Furthermore, count of the predetermined time period K3A is performed by a predetermined timer of the timer section 105 in accordance with a predetermined number of counts.

As described above, in this aspect, after the lapse of the predetermined time K2 from the time point t1 where the printing flag signal (main_vsync) is activated, the main ASIC 102 deactivates the printing flag signal (main_vsync). Then, based on the given delay time d2 from the time point t4 where the printing flag signal (main_vsync) is deactivated, the main ASIC 102 estimates the time point t5 where the sub ASIC 114 terminates the exposure processing of the LED units 40 based on the preceding print data outputted to the sub ASIC 114.

Therefore, even in the case where the main ASIC 102 and the sub ASIC 114 asynchronously operate, the main ASIC 102 can know the exposure termination timing of the sub ASIC 114 without having any dedicated line to receive the exposure termination timing signal therethrough.

Furthermore in this aspect, as described above, the main ASIC 102, at the time point t3, starts outputting the partial registration setting communication data (the partial second data) which corresponds to the succeeding print data (the first data) and has no influence on the exposure processing executed by the sub ASIC 114 to the sub ASIC 114. Therefore, even in the case where the data for performing the register setting of the sub ASIC 114 in a page interval K3 is increased, the page interval K3 can be shortened.

Next, at a time point t7, the leading edge of a sheet P for the next printing cycle passes the sensor SI. Then, after a time point t8, the main ASIC 102 and the sub ASIC 114 repeat the processing between the time points t1 and t7 until printing of a required number of pages is terminated.

Note that the print data (print_data) is transferred from the main ASIC 102 to the sub ASIC 114 in accordance with the data request signal of the sub ASIC 114 essentially during the time period KS where the sub printing flag signal (sub_vsync) is ON (activated).

<Other Aspects>

The present invention is not limited to the illustrative aspect as described above with reference to the drawings. The following aspects may be included in the technical scope of the present invention, for example.

(1) In the above illustrative aspect, the main ASIC 102 illustratively estimates the time point t5 where the sub ASIC 114 terminates the exposure processing, and the estimation is based on the given delay time d2 from the time point t4 where the printing flag signal (main_vsync) is deactivated. The present invention is not limited to this. The main ASIC 102 may include a table TB, as illustrated in FIG. 5 for example, that shows a relationship between printing speeds (the contents of the print job) and set values (data for estimating the termination timing of the processing executed by the sub ASIC 114) so as to estimate the exposure processing termination time point t5 using the data in the table TB. In this case, the table TB is stored, for example, in the ROM of the memory section 103.

Note that the set values, which is the data for estimating the processing timing of the sub ASIC 114, in FIG. 5 is illustratively the number of scanning lines from the time point t4 in FIG. 4. That is, in one aspect, in a case where the printing speed is a "full speed" for example, the main ASIC 102 estimates a time point after the time period corresponding to "four" scanning lines from the time point t4 in FIG. 4 to be the time point t5 where the sub ASIC 114 terminates the exposure processing.

Also in this case, the time point t5 where the sub ASIC 114 terminates the exposure processing is desirably estimated without increasing the number of the signal lines of the flat cable 140. Note that the contents of the print job in the table are not limited to the printing speeds but may be the size of the printing sheet. The table likewise may include both of the printing speeds and the sizes of the printing sheets.

(2) The above illustrative aspect is illustrated such that the sub ASIC 114 starts the exposure processing at the time point t2 and, thereafter, the main ASIC 102 starts outputting the partial succeeding register setting communication data which has no influence on the exposure processing executed by the sub ASIC 114. The present invention is not limited to this. For example, it may be configured such that the main ASIC 102 terminates outputting the preceding print data and register setting communication data to the sub ASIC 114 (at the time point t4 and thereafter in FIG. 4) and, thereafter, the main ASIC 102 starts outputting the partial register setting communication data which corresponds to the succeeding print data and has no influence on the exposure processing to the sub ASIC 114. In this case, the other partial register setting communication data which has influence on the exposure processing is, similar to the above illustrative aspect, outputted to the sub ASIC 114 during the time period K3B in FIG. 4.

With this configuration, in a case where the printing page interval (the time period K3 in FIG. 4) has some allowance, processing performance of the LED units 40 can be improved in comparison with a case where the sub ASIC 114 terminates the processing based on the preceding print data and, thereafter, the main ASIC 102 outputs the succeeding print data and the entire register setting communication data. Furthermore, in comparison with the above illustrative aspect, at the time point t3 in FIG. 4, the main ASIC 102 does not have to issue the interrupt to the CPU 103. That is, the CPU 103 can perform another processing.

(3) In the above illustrative aspect and the above other aspects, the estimation of the delay time d1 in FIG. 4 may be made using a predetermined table similar to the estimation of the delay time d2 of the other aspect (1). In this case, it is preferable that the table shows a relationship between the contents of the print job and start timing of the processing executed by the sub ASIC 114 (the second processing component).

(4) The configuration may be such that the time point t5 (where the sub ASIC 114 terminates the exposure processing) is estimated as described above and, thereafter, the entire register setting communication data (setting_reg_data) is sent from the main ASIC 102 to the sub ASIC 114 within the time period K3B in FIG. 4. Also with this configuration, in the case where the main ASIC 102 and the sub ASIC 114 asynchronously operate, the entire register setting communication data can be desirably sent from the main ASIC 102 to the sub ASIC 114 without any dedicated line for sending the exposing termination timing signal therethrough.

(5) The exposing unit is not limited to the illustration of the above illustrative aspect where the LED heads 41 (having the LEDs) are adopted. For example, the exposing unit may be an exposing member having, instead of the LEDs, EL (electro luminescence) elements, fluorescent elements, and the like. Furthermore, the exposing unit may be one having many arrayed light shutters (such as liquid crystal elements or PLZT elements) that controls light from a single or a plurality of light sources and, based on image data, selectively controls the switch time of the light shutters.

What is claimed is:

1. An image forming apparatus, comprising:

an exposing unit;

a first processing component configured to generate print data and register setting data, the print data causing the exposing unit to blink in accordance with image data, and the register setting data that is referred to in exposing processing of the exposing unit based on the print data; and a second processing component including a register to which the register setting data is set and connected to the first processing component through a first signal line, the second processing component configured to receive the print data and the register setting data from the first processing component, and to perform blink control of the exposing unit based on the print data and the register setting data, wherein the exposing unit is connected to the second processing component through a second signal line;

the second processing component configured to select the register setting data that corresponds to the print data and, thereafter, execute the blink control of the exposing unit based on the print data and in accordance with a blink mode set by the register setting data, and start exposure of the exposing unit based on the print data inputted thereto, and after the second processing component starts the exposure processing of the exposing unit based on preceding print data inputted, the first processing component starts outputting a part of the register setting data that corresponds to a succeeding print data, and, after the second processing component terminates the exposure processing of the exposing unit based on the preceding print data, the first processing component outputs the succeeding print data and the remaining part of the register setting data.

2. The image forming apparatus according to claim 1, wherein the first processing component terminates outputting the preceding print data and the register setting data to the second processing component and, thereafter, the first processing component starts outputting the part of the register setting data that corresponds to the succeeding print data.

3. The image forming apparatus according to claim 1, wherein the first signal line includes a high-speed signal line and a low-speed signal line, the low-speed signal line being configured to have a lower data transfer speed than the high-speed signal line, and the high-speed signal line being used to output at least the print data.

4. The image forming apparatus according to claim 1, wherein the first processing component further includes a table configured to show a relationship between contents of a print job and a plurality of data, the plurality of data estimating timing when the second processing component terminates the processing, and the first processing component estimates timing when the second processing component terminates the exposure processing of the exposing unit based on the preceding print data inputted to the second processing component, the estimation being performed using the plurality of data of the table.

5. The image forming apparatus according to claim 4, wherein the contents of the print job includes at least one of a printing speed and a size of a printing sheet.

6. The image forming apparatus according to claim 1, further comprising a sensor configured to detect when a recording medium passes and to generate a detection signal, and the first processing component being configured to generate a flag signal, wherein:

the first processing component activates the flag signal based on the detection signal of the sensor, and the first processing component estimates the timing when the second processing component starts the exposure processing of the exposing unit based on the preceding print data inputted to the second processing component based on a given delay time from the timing when the flag signal is activated.

7. The image forming apparatus according to claim 6, wherein:

the first processing component deactivates the flag signal after a given time from a timing when the flag signal is activated, and the first processing component estimates the timing when the second processing component terminates the exposure processing of the exposing unit based on the preceding print data inputted to the second processing component based on a given delay time from a timing when the flag signal is deactivated.

8. The image forming apparatus according to claim 1, further comprising a body and a cover, the cover configured to cover the body, wherein: the exposing unit includes a plurality of light-emitting elements, the print data causes the plurality of light-emitting elements to blink, the body includes the first processing component, and the cover holds the exposing unit and the second processing component.

* * * * *